US007993052B2

(12) United States Patent
Sakamoto et al.

(10) Patent No.: US 7,993,052 B2
(45) Date of Patent: Aug. 9, 2011

(54) AGITATION MIXER AND FEED PIPE STRUCTURE

(75) Inventors: Nobuyuki Sakamoto, Tsukuba (JP); Kenshiro Shuto, Tsukuba (JP); Satoshi Yamada, Ushiku (JP); Hirofumi Irie, Tokyo (JP)

(73) Assignee: NOF Corporation, Tokyo (JP)

( * ) Notice: Subject to any disclaimer, the term of this patent is extended or adjusted under 35 U.S.C. 154(b) by 896 days.

(21) Appl. No.: 11/863,634

(22) Filed: Sep. 28, 2007

(65) Prior Publication Data

US 2008/0080304 A1 Apr. 3, 2008

(30) Foreign Application Priority Data

Sep. 28, 2006 (JP) ..... 2006-265199

(51) Int. Cl.
*B01F 7/04* (2006.01)

(52) U.S. Cl. ..... 366/178.1; 366/172.1; 366/172.2

(58) Field of Classification Search ..... 366/178.1, 366/178.3, 172.1, 172.2, 171.1, 181.4
See application file for complete search history.

(56) References Cited

U.S. PATENT DOCUMENTS

| | | | | | |
|---|---|---|---|---|---|
| 328,585 | A | * | 10/1885 | Hornbostel | 366/171.1 |
| 2,641,453 | A | * | 6/1953 | Teale | 366/178.1 |
| 3,744,763 | A | * | 7/1973 | Schnoring et al. | 366/178.1 |
| 4,162,128 | A | * | 7/1979 | Ogden et al. | 366/158.5 |
| 4,187,143 | A | | 2/1980 | Sander et al. | |
| 5,018,871 | A | * | 5/1991 | Brazelton et al. | 366/169.1 |

FOREIGN PATENT DOCUMENTS

| | | | |
|---|---|---|---|
| DE | 3123743 | A1 | 3/1982 |
| GB | 1479068 | | 7/1977 |
| GB | 2169814 | | 7/1986 |
| JP | 2001-139692 | A | 5/2001 |
| JP | 2004-292544 | A | 10/2004 |
| JP | 2005-320444 | A | 11/2005 |
| WO | 93/10665 | A | 6/1993 |
| WO | 03/033097 | A2 | 4/2003 |
| WO | 2005/032703 | A1 | 4/2005 |

OTHER PUBLICATIONS

UK Search Report for Application No. GB0718899.8, mailed on Jan. 30, 2009.
Combined Search and Examination Report under Sections 17 and 18(3), dated Jan. 17, 2008, issued for Application No. GB0718899.8.

* cited by examiner

*Primary Examiner* — David Sorkin
(74) *Attorney, Agent, or Firm* — Colin P. Cahoon; Celina M. Orr; Carstens & Cahoon, LLP

(57) ABSTRACT

An agitation method for mixing a solution and a solvent to precipitate a solid substance from the solution. The method includes preparing an agitation mixer including an agitation vessel, an impeller rotated in the agitation vessel, and a feed pipe connected to the agitation vessel and having a multiple pipe structure including an outer pipe and an inner pipe arranged in the outer pipe. A shearing clearance is formed in the agitation vessel between the impeller and the feed pipe. The method further includes shearing the solution and the solvent by rotating the impeller to precipitate the solid substance while feeding the solution and the solvent into the shearing clearance from the outer pipe and the inner pipe.

12 Claims, 5 Drawing Sheets

AGITATION MIXER AND FEED PIPE STRUCTURE

BACKGROUND OF THE INVENTION

The present invention relates to an agitation method, an agitation mixer, and a feed pipe structure.

When manufacturing pharmaceutical products, chemical products, and food products, agitation is often performed to purify or separate a target compound. An agitation mixer used for such agitation typically includes an agitation vessel and an impeller arranged in the agitation vessel. The impeller agitates gases, liquids, solids, or a multiphase flow of these matters in the agitation vessel to cause various types of reactions, such as crystallization and polymerization.

Crystallization is one of separation-purification processes and includes re-crystallizing or precipitating crystal grains from a supersaturated solution. Further, crystallization is a method for not only precipitating a target substance but also for purifying grains having a target property, such as a desirable grain diameter. When purifying gains, a solution is agitated by an agitation mixer to disperse the grains in a liquid (solvent) and produce solid-liquid multiphase slurry. The slurry is then filtered and dried to obtain the desired solid grains. Precipitation purification is one example of crystallization performed with polymer grains. In precipitation purification, a poor solvent is added to a polymer solution to prepare a slurry. Then, the slurry is filtered and dried to obtain solid polymer grains (refer to Japanese Laid-Open Patent Publication No. 2005-320444, Japanese Laid-Open Patent Publication No. 2004-29254, and Japanese Laid-Open Patent Publication No. 2001-139692).

From the viewpoint of the amount that can be processed, it is preferable that continuous processing be performed instead of batch processing when performing agitation during a manufacturing process. FIG. 9 shows a main body 100 of a conventional continuous processing type agitation mixer. The main body 100 is connected to a first feed pipe 101, which is for feeding a first liquid (e.g., polymer solution P). A second feed pipe 102 for feeding a second liquid (e.g., poor solvent S) is connected to the first feed pipe 101 just before the main body 100. Accordingly the main body 100 is fed with a liquid mixture of the polymer solution P and the poor solvent S. The liquid mixture of the polymer solution P and the poor solvent S is agitated in the main body 100 and then discharged from the main body 100 through a discharge pipe 103.

SUMMARY OF THE INVENTION

The main body 100 has a problem in that, for example, when performing precipitation purification with polymer grains, the polymer solution P solidifies when coming into contact with the poor solvent S just before the main body 100. The solidification may produce undesirable solids having a large size and absorbing impurities such as unreacted polymer solution P and poor solvent S. SIn addition, such solids may form flocculent aggregation F (refer to FIG. 9). In the first feed pipe 101, the formation of non-uniform slurry or flocculent aggregation F may hinder stable supply of the polymer solution P and the poor solvent S to the main body 100. In addition, the first feed pipe 101 may be ruptured at the portion that is clogged by the flocculent aggregation F. Further, when the polymer solution P is fed to the main body 100 in a partially solidified state, a solid in the polymer solution P may act as a crystal core and form a polymer grain having an excessively large grain diameter. As a result, this would produce polymer grains having a grain diameter that is larger than the desirable grain diameter or polymer grains having non-uniform grain diameters.

When liquids subject to agitation are mixed together just before the main body 100, the flocculent aggregation formation lowers the manufacturing efficiency and cause the crystal grains or precipitation grains to have non-uniform diameters. In such a case, grains having the desirable grain diameter cannot be obtained. Such a phenomenon is not limited to the precipitation purification of polymer grains. When instilling a sufficiently diluted polymer solution P into a poor solvent S, a large amount of the poor solvent S becomes necessary and the manufacturing efficiency decreases drastically. To solve this problem, a plurality of fluids may be continuously fed to the agitation vessel (not shown) of the main body 100 through a plurality of inlets formed at a plurality of locations in the agitation vessel. However, the plurality of inlets would lower the shearing effect produced between the wall of the agitation vessel and the impeller. Moreover, the inlets affect the seal of the agitation vessel in an undesirable manner. The feeding of a plurality of fluids to the agitation vessel through a plurality of inlets also lowers the diffusion effect of each liquid.

The present invention provides an agitation method, an agitation mixer, and a feed pipe structure that enables the formation of a solid substance having a fine and uniform diameter.

One aspect of the present invention is an agitation method for mixing a solution and a solvent that precipitate a solid substance dissolved in the solution to prepare a slurry of the solid substance. The method includes preparing an agitation mixer including an agitation vessel, an impeller rotatable in the agitation vessel, and a feed pipe connected to the agitation vessel and having a multiple pipe structure including an inner pipe and an outer pipe arranged outside the inner pipe. A shearing clearance is formed in the agitation vessel between the impeller and the feed pipe. The method further includes shearing the solution and the solvent by rotating the impeller to precipitate the solid substance while feeding the solution and the solvent into the shearing clearance from the outer pipe and the inner pipe.

In one embodiment, the solid substance is a polymer composition obtained by polymerizing a monomer composition the solution contains the polymer composition, and the solvent is a poor solvent.

In one embodiment, the solid substance is a phosphorylcholine base polymer, the solution is a liquid composition containing the phosphorylcholine base polymer, the solvent is a poor solvent, and the method purifies the phosphorylcholine base polymer by performing precipitation purification.

Another aspect of the present invention is an agitation mixer for agitating a solution and a solvent that precipitates a solid substance dissolved in the solution. The agitation mixer includes an agitation vessel. An impeller is rotatably arranged in the agitation vessel for shearing the solution and the solvent when rotated. The agitation mixer also includes a feed unit having a structure formed of a plurality of pipes including an inner pipe and an outer pipe arranged outside the inner pipe. A discharge port discharges agitated fluid from the agitation vessel. A shearing clearance is formed between the feed unit and impeller. The outer pipe feeds one of the solution and the solvent to the shearing clearance. The inner pipe feeds the other one of the solution and the solvent to the shearing clearance. The solution and the solvent initially come in contact with each other in the shearing clearance.

A further aspect of the present invention is a feed pipe structure for connection to an agitation vessel of an agitation mixer for feeding the agitation vessel with a solution in which a solid substance is dissolved and a solvent that precipitates the solid substance from the solution. The feed pipe structure includes a multiple pipe structure including an inner pipe and an outer pipe arranged outside the inner pipe in which a gap is formed between the outer pipe and the inner pipe. The structure feeds the solution and the solvent from the inner pipe and from the gap.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An agitation mixer according to a preferred embodiment of the present invention will now be described with reference to FIGS. 1 to 7. The illustrated agitation mixer is suitable for obtaining powdered grains (solid substance) of a polymer having phosphorylcholine moiety or phosphorylcholine analog moiety (hereafter referred to as PC polymers).

Figure 1:
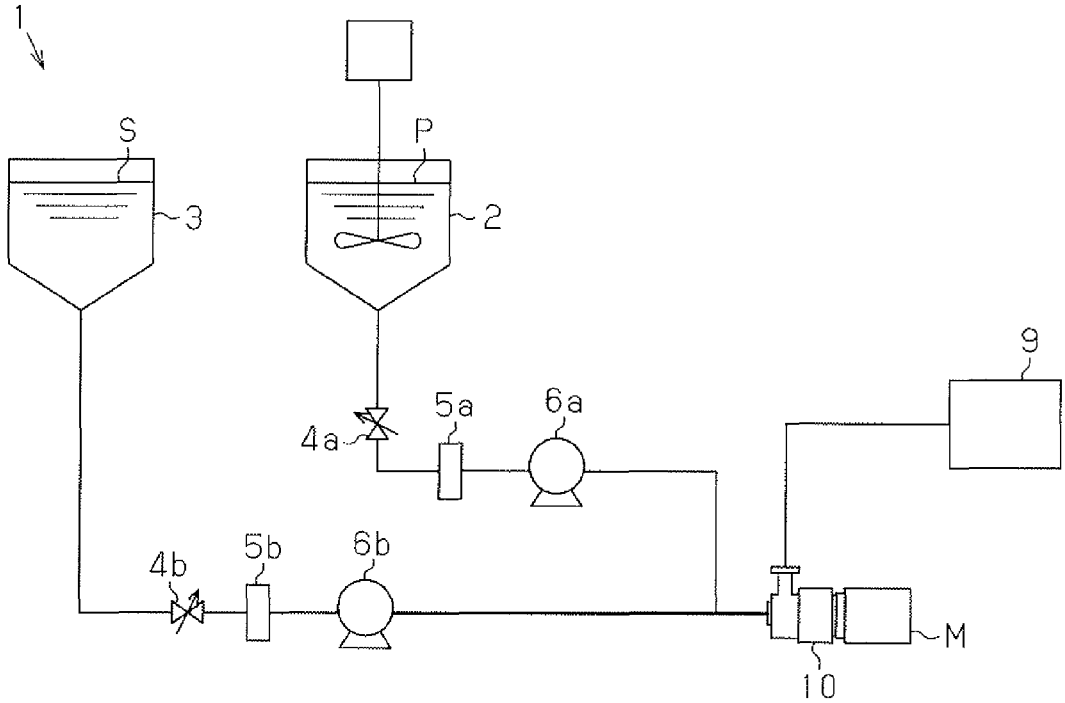
FIG. 1 is a schematic diagram of a precipitation purification system according to a preferred embodiment of the present invention.

A precipitation purification system 1 for preparing slurry containing PC polymers will now be discussed with reference to FIG. 1. As shown in FIG. 1, the precipitation purification system 1 includes a polymerization tank 2 (polymer solution source) for holding a polymer solution P serving as a solution and a polymer composition, a solution tank 3 (solution source) for holding a poor solvent S, an inline mixer 10 serving as an agitation mixer, and a filter 9. The polymerization tank 2 functions as a reaction tank in which a monomer having phosphorylcholine moiety or phosphorylcholine analog moiety is polymerized to produce the polymer solution P. In the polymerization tank 2, a PC monomer and a polymerization initiator respectively fed from a monomer feed tank and a polymerization initiator tank (neither shown) are mixed to produce the polymer solution P containing PC polymers.

A flow rate control valve 4*a*, a flow rate meter 5*a*, and a pump 6*a* are arranged between the polymerization tank 2 and the inline mixer 10. The flow rate control valve 4*a* controls the flow rate of the polymer solution P, which is fed to the inline mixer 10, based on the flow rate measured by the flow rate meter 5*a*. The pump 6*a* forcibly sends the polymer solution P that is filtered by filter (not shown) to the inline mixer 10.

It is preferred that a pulseless pump be used as the pump 6*a*, The use of a pulse pump results in pump pulsations cyclically disturbing the balance of the amount of the polymer solution P and the amount of the poor solvent S fed to the inline mixer 10. In such a case, the feed amount of the polymer solution P becomes excessive or insufficient relative to the feed amount of the poor solvent S. This produces flocculent aggregation from unreacted PC monomers, the solvent or the like. The flocculent aggregation adheres to various parts of the inline mixer and interferes with the formation of uniform grains.

Instead of using the pump 6*a*, inert gas such as nitrogen may be pressurized in the polymerization tank 2 in a hermetic state so that the polymer solution P is forcibly sent to the inline mixer 10 from the polymerization tank 2 by the gas pressure. Such gas pressurization may be performed in combination with the operation of the pump 6*a*.

A flow rate control valve 4*b*, a flow rate meter 5*b*, and a pump 6*b* are arranged between the solvent tank 3 and the inline mixer 10. The flow rate meter 5*b* measures the flow rate of the poor solvent S and provides the measurement to the flow rate control valve 4*b*. The flow rate control valve 4*b* controls the flow rate of the poor solvent S so that the ratio of the feed amount of the polymer solution P and the feed amount of the poor solvent S become equal to a predetermined value. The pump 6*b* forcibly sends the poor solvent S, which is filtered by a filter (not shown) as necessary, to the inline mixer 10. It is preferred that a pulseless pump such as that used for the pump 6*a* be used as the pump 6*b*. Further, in the same manner as the pump 6*a*, gas pressurization may be employed in lieu of the pump 6*b*, and gas pressurization may be performed in combination with the operation of the pump 6*b*.

The polymerization tank 2 and the solvent tank 3 respectively feed the polymer solution P and the poor solvent S to the inline mixer 10. The inline mixer 10 agitates the polymer solution P and the poor solvent S to prepare slurry containing fine PC monomer grains. Then, the inline mixer 10 sends the slurry to the filter 9.

The filter 9 performs solid-liquid separation on the slurry and recovers solid components as a cake. Pressurized filtering, which uses nitrogen back pressure, depressurizing filtering, or centrifugal filtering may be performed to filter the slurry. Since the amount of residual solvent in the slurry cake is small, centrifugal filtering is preferable. An inorganic or organic filtering material is arranged in the filter 9. The preferred organic filtering material is a non-woven cloth made of one or more polymer materials selected from polyethylene, polypropylene, and Teflon (registered trademark). A non-woven cloth of long polymer fibers is preferable since contamination to powders is low. The preferred inorganic filtering material is a porous ceramic body or metal sinter. Ventilation drying or depressurization drying may be performed to dry the cake.

Figure 2:
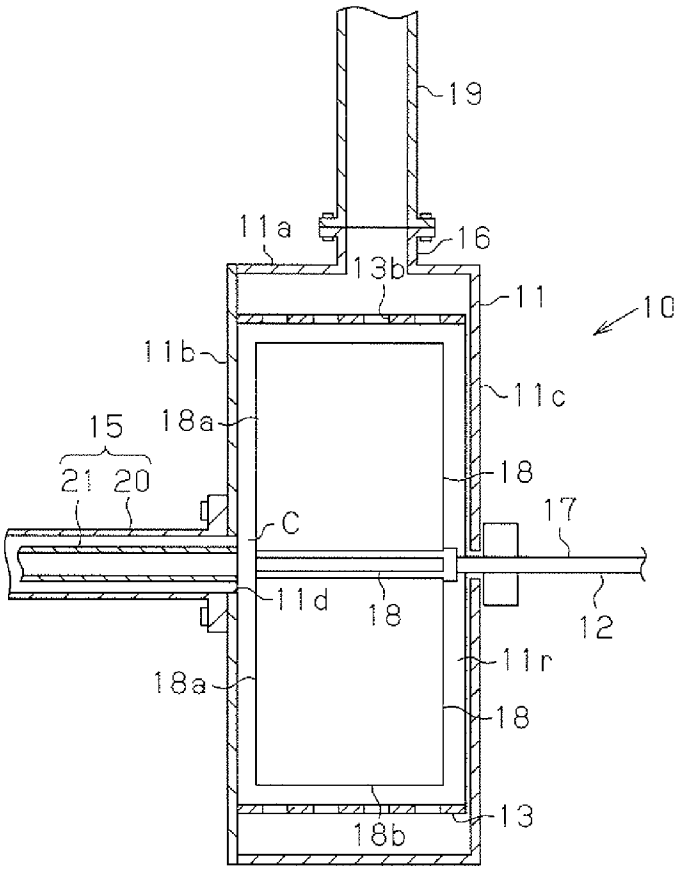
FIG. 2 is a cross-sectional view of an inline mixer.

The inline mixer 10 will now be described in detail with reference to FIGS. 2 to 7. As shown in FIG. 2, the inline mixer 10 includes an agitation vessel 11 (stator), an impeller 12, a screen 13, and a feed pipe 15. The agitation vessel 11 includes a main body 11*a*, which is cylindrical and has a closed bottom, and a lid 11*b*, which is for closing the opening of the main body 11*a*. The main body 11*a* has an outer surface including a discharge port 16. The discharge port 16 is connected to a discharge pipe 19 for discharging slurry out of the agitation vessel 11. An inlet 11*d* is formed in the central portion of the lid 11*b*. The polymer solution P and the poor solvent S are drawn into the agitation vessel 11 through the inlet 11*d*. A cylindrical agitation chamber 11*r* is defined within the main body 11*a* and lid 11*b*. The agitation chamber 11*r* rotatably accommodates the impeller 12.

Figure 3:
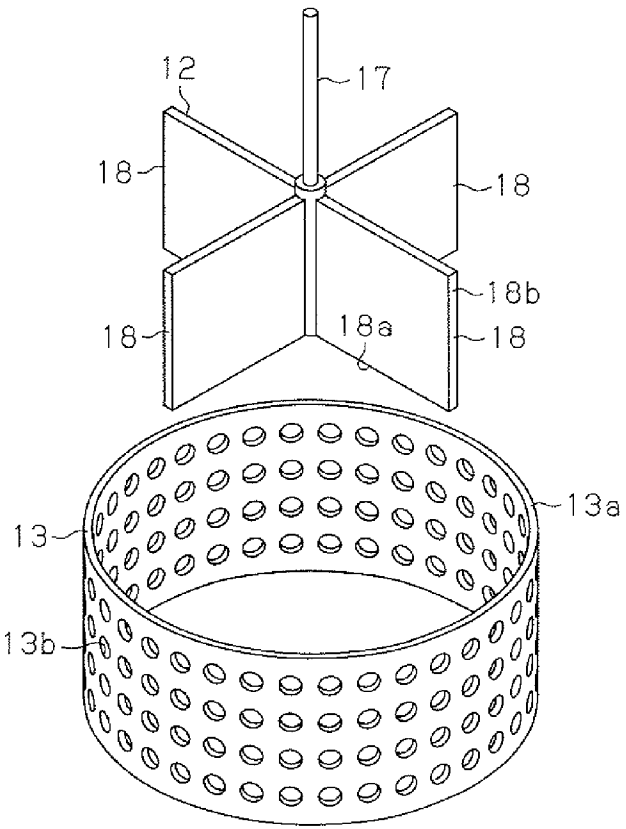
FIG. 3 is a perspective view showing an impeller and a screen.

As shown in FIG. 3, the impeller 12 includes a rotary shaft 17 connected to a motor M (refer to FIG. 1) and planar rotor blades 18 extending from the distal portion of the rotary shaft 17. The impeller 12 is a paddle impeller including four rotor blades 18 arranged so as to form the shape of a cross. The shape of the impeller 12 is not particularly limited. For example, the impeller 12 maybe a turbine impeller, a propeller impeller, or a pitch paddle impeller. The rotary shaft 17 of the impeller 12 is coaxial to the inlet 11*d* formed in the lid 11*b* and extends trough a bottom wall 11*c* of the agitation vessel 11. The distal end of the rotary shaft 17 is arranged in the vicinity of the inlet 11*d*. When the motor M is driven, the rotor blades 18 fixed to the rotary shaft 17 are rotated about the rotary shaft 17 in the agitation chamber 11*r*.

As shown in FIGS. 2 and 3, the screen 13, which is cylindrical, is arranged around the impeller 12. The screen 13 has a diameter determined so that a clearance of 0.1 mm to about 10.0 mm is provided between distal ends 18*b* of the rotor blades 18 and an inner surface of the screen 13. The screen 13 includes a plurality of through holes 13*b* arranged at equal intervals. The through holes 13*b* may be round holes having the same diameter or rectangular holes. The shape and arrangement of the through holes 13*b* is not particularly limited.

Figure 4:
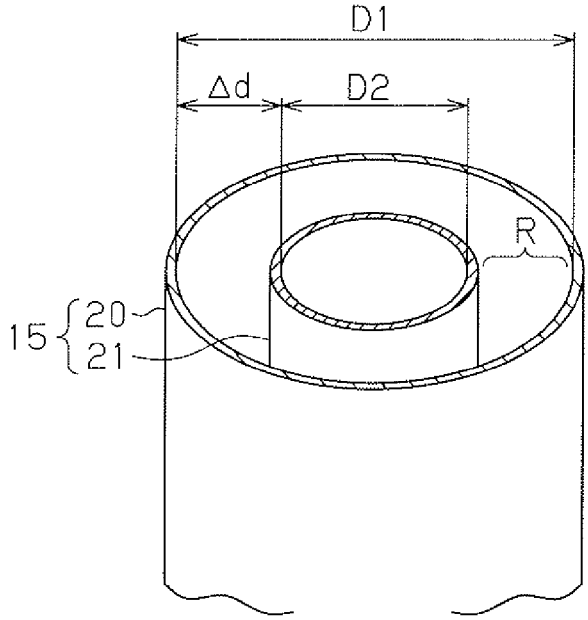
FIG. 4 is a cross-sectional view of a feed pipe.

The feed pipe 15 connected to the agitation vessel 11 and functioning as a feed pipe structure or a feed unit will now be described in detail with reference to FIG. 2. The feed pipe 15 is connected to the inlet 11*d* in the lid 11*b* of the agitation vessel 11. As shown in FIG. 4, the feed pipe 15 is a coaxial multiple pipe structure (coaxial dual pipe structure) including an outer pipe 20 and an inner pipe 21. The feed pipe 15, which has a multiple pipe structure, increases the liquid feed amount and improves the production efficiency. Further, the multiple pipe structure minimizes pressure loss in the outer pipe and inner pipe 21. This enables the feeding of liquid having a relatively large viscosity without causing clogging.

Although not particularly limited, the preferred material for the outer pipe 20 and inner pipe 21 is stainless steel or tetrafluoroethylene. From the viewpoint of the withstand pressure, the preferred material is stainless steel. The outer pipe 20 has an inner diameter D1 and the inner pipe 21 has an inner diameter D2. It is preferred that the inner diameters D1 and D2 are 0.5 mm or greater to prevent pressure loss when liquid is being fed and 50 mm or less to prevent a reversed flow from the agitation vessel 11. The inner diameter ratio of the inner pipe 21 and the outer pipe 20 (D1/D2) is preferably 1.3 to 4.0. The ratio of the cross-sectional area of the inner pipe 21 and the cross-sectional area of the outer pipe 20 is preferably 0.5 to 15.

Figure 5:
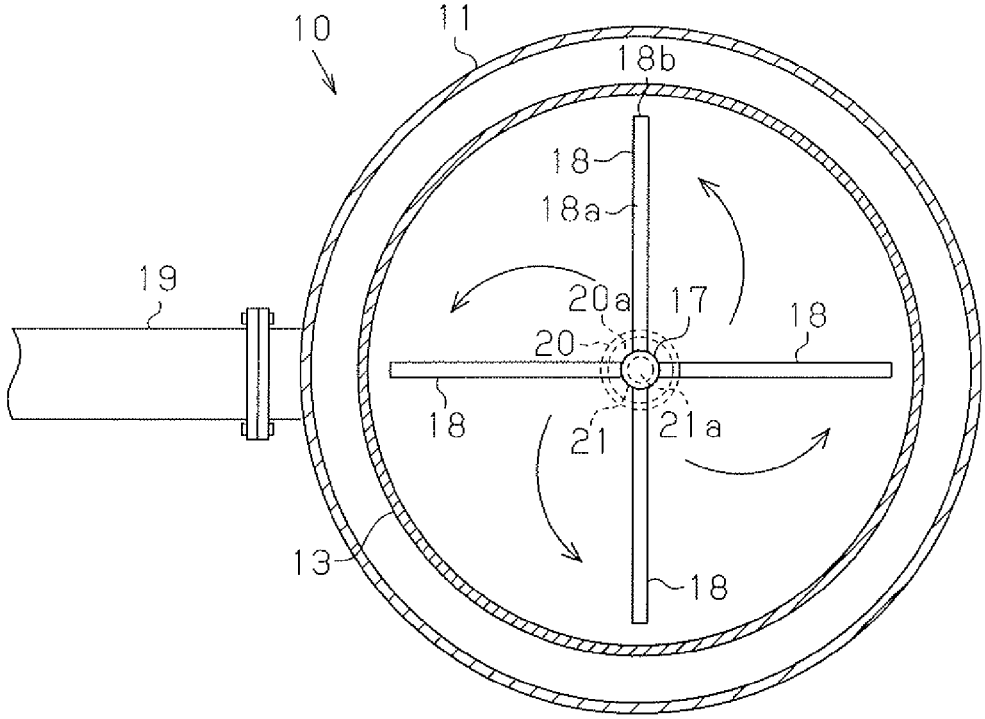
FIG. 5 is a cross-sectional view of an inline mixer.

The inner pipe 21 and the outer pipe 20 are coaxial. Thus, an annular gap R (annular passage) having a constant width Δd is defined between the inner pipe 21 and the outer pipe 20. As shown in FIG. 5, the inner pipe 21 has an axis that lies along the rotary shaft 17 of the impeller 12.

The outer pipe 20 is connected to the solvent tank 3. The poor solvent S is fed from the inlet 11*d* of the agitation vessel 11 to the agitation chamber 11*r* through the gap R formed between the outer pipe 20 and inner pipe 21. The inner pipe 21 is connected to the polymerization tank 2. The polymer solution P is supplied to the agitation vessel 11 through the inner pipe 21. In this manner, the polymer solution P and poor solvent S flowing through the feed pipe 15 do not mix before reaching the agitation vessel. This prevents slurry containing impurities or flocculent aggregation from being formed in the feed pipe 15. Further, the poor solvent S enters the agitation vessel 11 in a state encompassing the polymer solution P. Thus, the PC polymers contained in the polymer solution P effectively contact the poor solvent S.

The inventors of the present invention have checked through experiments that the aggregation of the polymer solution P (flocculent aggregation formation) is prevented by having the poor solvent S, and not the polymer solution P, flow through the outer pipe 20 and the polymer solution P flow through the inner pipe 21. If the polymer solution P were to flow through the outer pipe 20 and the poor solvent S were to flow through the inner pipe 21, the polymer solution P would not enter the agitation vessel 11 in a state encompassed by the poor solvent S. Thus, the polymer solution P entering the inlet 11*d* would be dispersed near the lid 11*b* of the agitation vessel 11. This would easily result in flocculent aggregation formation. As a result, polymer flocculent aggregation may collect on the impeller 12 or the agitation vessel 11 and interfere with the rotation of the impeller 12 or smooth slurry flow. Such a problem is avoided by having the poor solvent S flow through the outer side of the feed pipe 15 (i.e., outer pipe 20) and the polymer solution P flow through the inner side of the feed pipe 15 (i.e., inner pipe 21).

The feed pipe 15 is connected to the inlet 11*d* formed in the central portion of the lid 11*b*. As shown in FIG. 5, the outer pipe 20 has an outlet 20*a* and the inner tube 21 has an outlet 21*a*. The outlets 20*a* and 21*a* face toward the distal end of the impeller 12. The outlet 20*a* of the outer pipe 20, the outlet 21*a* of the inner pipe 21, and the rotary shaft 17 of the impeller 12 are coaxial. Referring to FIG. 2, the rotor blades 18 of the impeller 12 each have a lower end 18*a* separated from the outlet 20*a* of the other pipe 20 and the outlet 21*a* of the inner pipe 21 (or the lid 11*b*) by a distance of preferably 0.5 to 30.0 mm. A disk-shaped shearing clearance C is formed between the lower ends 18*a* of the rotor blades 18 and the outlet 20*a* of the other pipe 20 and the outlet 21*a* of the inner pipe 21 (or the lid 11*b*). The shearing clearance C is preferably 0.5 to 30.0 mm. The shearing clearance C is dimensioned such as to reduce the rotation load on the impeller 12. Further, the shearing clearance C functions as a high shearing force region for shearing the liquid in the shearing clearance C with a relatively large shearing force. When the shearing clearance C extends for a distance of less than 0.5 mm, the gap between the impeller 12 and the lid 11*b* of the agitation vessel 11 would be too narrow. As a result, the flow of slurry would become difficult and the load applied to the impeller 12 would be increased. On the other hand, if the shearing clearance C exceeds 30.0 mm, the shearing of liquid in the shearing clearance C would become insufficient, and it would become difficult to obtain polymer grains having a relatively small grain diameter. Further, polymer flocculent aggregation having a tendency of collecting on the impeller 12 would easily be formed.

As shown in the state of FIG. 2, the inline mixer 10 may be arranged so that the feed pipe 15 extends horizontally. The inline mixer 10 may also be arranged so that the feed pipe 15 extends vertically. When the inline mixer 10 is arranged so that the feed pipe 15 extends vertically, the polymer solution P and the poor solvent S may flow in either vertically downward or upward directions. Regardless of the direction the inline mixer 10 is arranged, the polymer solution P and the poor solvent S are sheared by the impeller 12 the moment they enter the agitation vessel 11 through the inlet 11*d*. Thus, the inline mixer 10 may be arranged to face any direction.

The operation of the inline mixer 10 will now be discussed with reference to FIG. 6. The polymer solution P is encompassed by the poor solvent S, which enters the shearing clearance C, the moment the polymer solution P enters the shearing clearance C from the inner pipe 21. At the same time, the impeller 12 agitates the polymer solution P and poor solvent S in the shearing clearance at a rotation speed of 2,000 to 10,000 rpm. This increases the contact rate between PC polymers and the poor solvent S. Thus, many PC polymers come into contact with the poor solvent S and instantaneously solidify (precipitation purification) in this state. This produces a slurry SL in which PC polymer grains are dispersed in the poor solvent S. In this manner, the increase in the contact rate between PC polymers and the poor solvent S reduces unreacted PC polymers in the slurry SL.

The slurry SL is sheared by a strong shearing force in the shearing clearance C between the rotating rotor blades 18 and the lid 11*b*. The polymer solution P and the poor solvent S flow into the agitation vessel 11 in a direction perpendicular to the rotation direction of the impeller 12. Thus, the slurry SL is effectively sheared. Further, as shown by the arrows in FIG. 5, the slurry SL is forced in a radially outward direction from the rotary shaft 17 toward the distal ends 18*b* of the rotor blades 18. The outlets 20*a* and 21*a* of the outer and inner pipes 20 and 21 of the feed pipe 15 are coaxial with the rotary shaft 17. Further, the feed pipe 15 is arranged in the vicinity of the distal end of the rotary shaft 17. Thus, in this state, the flow of the slurry SL is not biased toward one direction, and the slurry SL is uniformly forced toward the side wall of the agitation vessel 11.

Figure 6:
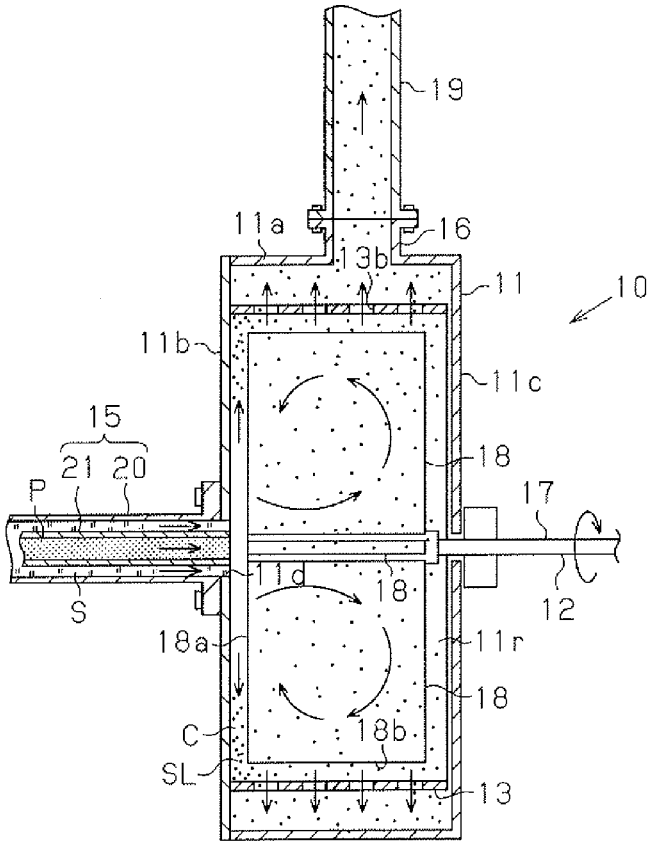
FIG. 6 is a cross-sectional view of the inline mixer illustrating the flow of liquid when the inline mixer is operating.

As shown in FIG. 6, in lie space between the rotor blades 18 and the screen 13, the slurry SL is agitated while forming a swirling flow. As a result, even the residual unreacted PC polymers in the slurry SL come into contact with the poor solvent S. As centrifugal force moves the slurry SL into the space between the distal ends 18*b* of the rotor blades 18 and the inner surface of the screen 13, the slurry SL is further sheared between the distal ends 18*b* of the rotor blades 18 and the screen 13 as the slurry SL moves circumferentially in the rotation direction of the impeller 12. Further, as shown in FIG. 6, the PC polymer grains are filtered into finer grains when passing through the through holes 13*b* of the screen 13.

The liquid feeding force from the polymerization tank 2 and the solvent tank 3 causes the slurry SL that has passed through the through holes 13*b* out of the screen 13 to move toward the discharge port 16. The slurry SL is then discharged out of the agitation vessel 11 through the discharge port 16 and temporarily collected in a collection tank (not shown). Subsequently, the slurry SL is sent to the filter 9.

The method for producing PC copolymers by performing precipitation purification and the operation of the inline mixer 10 will now be discussed.

The compound represented by equation (1) is an example of a PC monomer used in the present invention.

Equation (1)

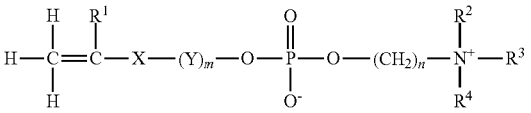

In equation (1), X represents a bivalent organic residue (moiety). Y represents alkyleneoxy group of carbon numbers 1 to 6. R1 represents hydrogen or the methyl group. R1 to R4 each represents a hydrogen atom or either one of the hydrocarbon group and hydroxy hydrocarbon group of carbon numbers 1 to 6. R1 to R4 may be the same group or different groups. Further, m represents an integer of 0 or 1, and n represents an integer of 2 to 4. From the viewpoint of availability, it is preferred that m is 1 and n is 2.

Examples of a bivalent organic residue represented by X are —$C_6H_4$—, —$C_6H_{10}$—, —(C═O)—O—, —O—, —$CH_2$—O—, —(C═O)—NH—, —O—(C═O)—, —$C_6H_4$—O—, —$C_6H_4$—$CH_2$—O—, —$C_6H_4$—(C═O)—O—. From the viewpoint of the simplicity for synthesizing PC monomer and the simplicity for polymerizing the obtained PC monomers, the most preferred X would be —(C═O)—O—. Examples of Y are the methyloxy group, ethyloxy group, propyloxy group, butyloxy group, pentyloxy group, hexyloxy group. From the viewpoint of availability, it is preferred that the ethyloxy group be used.

Examples of the PC monomer represented by equation (1) are, for example, 2-((meth)acryloyloxy)ethyl-2'-(trimethylammonio)ethyl phosphate (hereafter referred to as MPC), 3-((meth)acryloyloxy)propyl-2'-(trimethylammonio)ethyl phosphate, 4-((meth)acryloyloxy)butyl-2'-(trimethylammonio)ethyl phosphate, 5-((meth)acryloyloxy)pentyl-2'-(trimethylammonio)ethyl phosphate, 6-((meth)acryloyloxy)hexyl-2'-(trimethylammonio)ethyl phosphate, 2-((meth)acryloyloxy)ethyl-2'-(triethylammonio)ethyl phosphate, 2-((meth)acryloyloxy)ethyl-2'-(tripropylammonio)ethyl phosphate, 2-((meth)acryloyloxy)ethyl-2'-(tributylammonio)ethyl phosphate, 2-((meth)acryloyloxy)ethyl-2'-(tricyclohexylammonio)ethyl phosphate, 2-((meth)acryloyloxy)ethyl-2'-(triphenylammonio)ethyl phosphate, 2-((meth)acryloyloxy)ethyl-2'-(trimethanolammonio)ethyl phosphate, 2-((meth)acryloyloxy)propyl-2'-(trimethylammonio)ethyl phosphate, 2-((meth)acryloyloxy)butyl-2'-(trimethylammonio)ethyl phosphate, 2-((meth)acryloyloxy)pentyl-2'-(trimethylammonio)ethyl phosphate, 2-((meth)acryloyloxy)hexyl-2'-(trimethylammonio)ethyl phosphate, 2-(vinyloxy)ethyl-2'-(trimethylammonio)ethyl phosphate, 2-(allyloxy)ethyl-2'-(trimethylammonio)ethyl phosphate, 2-(p-vinylbenzyloxy)ethyl-2'-(trimethylammonio)ethyl phosphate, 2-(p-vinylbenzoiloxy)ethyl-2'-(trimethylammonio)ethyl phosphate, 2-(styryloxy)ethyl-2'-(trimethylammonio)ethyl phosphate, 2-(p-vinylbenzyl)ethyl-2'-(trimethylammonio)ethyl phosphate, 2-(vinyloxycarbonyl)ethyl-2'-(trimethylammonio)ethyl phosphate, 2-(allyloxycarbonyl)ethyl-2'-(trimethylammonio)ethyl phosphate, 2-((meth)acryloylamino)ethyl-2'-(trimethylammonio)ethyl phosphate, 2-(vinylcarbonylamino)ethyl-2'-(trimethylammonio)ethyl phosphate and the like.

The monomer composition used in the present invention may be prepared by mixing one of the above PC monomers or by mixing two or more of the above PC monomers. The above PC monomers may be obtained through a known synthesizing process. Japanese Laid-Open Patent Publication Nos. 54-63025 and 58-154591 describe examples of synthesizing processes.

In addition to the above PC monomers, the monomer composition used in the present invention may optionally contain at least one additional monomer polymerizable monomer) polymerizable with the PC polymers. Examples of the additional monomer are (meth)acrylic monomers, such as (meth)acrylic acid, 2-hydroxyethyl(meth)acrylate, 2-hydroxypropyl(meth)acrylate, 2-hydroxybutyl(meth)acrylate, polyethylene glycol mono(meth)acrylate, (meth)acrylic amide, aminoethyl(meth)acrylate, dimethylaminoethyl (meth)acrylate, methyl(meth)acrylate, ethyl(meth)acrylate, butyl(meth)acrylate, lauryl(meth)acrylate, stearyl(meth)acrylate, 2-ethylhexyl(meth)acrylate, benzyl(meth)acrylate, phenoxyethyl(meth)acrylate, glycidyl(meth)acrylate, (meth)acryloyl oxypropyl trimethoxy silane and the like; styrene derivative monomers, such as styrene, methylstyrene, chloromethylstyrene and the like; vinyl ether monomers, such as methylvinyl ether, butylvinyl ether and the like; vinylester monomers, such as vinylacetate, vinylpropionate and the like; unsaturated hydrocarbon monomers, such as ethylene, propylene, isobutylene and the like; and acrylonitrile.

The PC monomer composition of the present invention may be formed from one or more PC monomers. The PC monomer composition of the present invention may also be formed from a composition of one or more PC monomers with the additional monomers. When polymerizing the monomers in a PC monomer composition, a polymerization initiator is added to the PC monomer composition.

Examples of the monomer composition using both of the PC polymer and the additional monomer are a combination of MPC and a (meth)acrylate monomer, such as a combination of MPC and (meth)acrylic acid, a combination of MPC and 2-hydroxyethyl(meth)acrylate, a combination of MPC and 2-hydroxypropyl(meth)acrylate, a combination of MPC and 2-hydroxybutyl (meth)acrylate, a combination of MPC and polyethylene glycolmono(meth)acrylate, a combination of MPC and (meth)acrylic amide, a combination of MPC and aminoethyl(meth)acrylate, a combination of MPC and dimethylaminoethyl, a combination of MPC and (meth)acrylate, a combination of MPC and methyl(meth)acrylate, a combination of MPC and ethyl(meth)acrylate, a combination of MPC and butyl(meth)acrylate, a combination of MPC and lauryl(meth)acrylate, a combination of MPC and stearyl (meth)acrylate, a combination of MPC and 2-ethylhexyl (meth)acrylate, a combination of MPC and benzyl(meth) acrylate, a combination of MPC and phenoxyethyl(meth) acrylate, a combination of MPC and glycidyl(meth)acrylate, a combination of MPC and (meth)acryloyloxypropyltrimethoxy silane and the like; a combination of MPC and a styrene derivative monomer, such as a combination of MPC and styrene, a combination of MPC and methylstyrene, a combination of MPC and chloromethylstyrene and the like; a combination of MPC and a vinyl ether monomer, such as a combination of MPC and methylvinylethe, a combination of MPC and butylvinyl ether and the like, a combination of MPC and vinylestermonomer, such as a combination of MPC and vinylacetate, a combination of MPC and vinyl propionate and the like; a combination of MPC and an unsaturated hydrocarbon monomer, such as a combination of MPC and ethylene, a combination of MPC and propylene, a combination of MPC and isobutylene and the like; and a combination of MPG and acrylonitrile.

In the present invention, the polymerization initiator may be selected from known radical polymerization initiators. From the viewpoint of easiness of removal, preferable radical polymerization initiators are, for example, organic peroxides, such as, benzoil peroxide, t-butylperoxy-2-ethylhexanoate, succinyl peroxide, glutar peroxide, succinyl peroxyglutarate, t-butylperoxymalate, t-butylperoxypivalate, t-butylperoxyneodecanoate, di-2-ethoxyethyl peroxycarbonate and the like; azo compounds, such as azobisisobutyronitrile, dimethy 1-2,2'-azobisisobutylate 1-((1-cyano-1-methylethyl)azo)formamide, 2,2-azobis(2-methyl-N-phenylpropionamidine) dihydrochloride, 2,2-azobis(2-methyl-N-(2-hydroxyethyl)-propionamide), 2,2-azobis(2-methylpropionamide)dihydrate, 4,4-azobis(4-cyano-pentanate), 2,2-azobis(2-(hydroxymethyl)prooanenitrile) and the like. Such polymerization initiators can be used singly or as a combination of two or more kinds. The amount of polymerization initiator can be adjusted to control molecular weight of target copolymer, however, from the viewpoint of controlling convenience of the molecular weight and easiness of treatment using an adsorbent, it is preferred that the amount of polymerization initiator be 0.001 to 10% by weight, and more preferably 0.005 to 5% by weight per total weight of polymeirization solution containing polymers. If necessary known solvents, known additives and the like may be included in the monomer composition used in the present invention. A PC polymer composition containing a PC polymer can be obtained by polymerizing the monomer composition.

The polymerization reaction conditions for obtaining a polymer composition, namely, the reaction temperature and reaction period, are not particularly limited. However, for solution polymerization, the normal conditions are a polymerization temperature of 5 to 150° C., preferably 40 to 80° C., and the polymerization period is 10 minutes to 72 hours, preferably 30 minutes to 10 hours. Japanese Laid-Open Patent Publication Nos. 9-3132, 8-333421, and 11-35605 describe examples of processes for obtaining a polymer composition. The weight-average molecular weight (Mw) of the PC polymers in the obtained polymer composition is not particularly limited. However, from the viewpoint of handling convenience, it is preferred that the weight-average molecular weight (Mw) be 1,000 to 5,000,000, and more preferably, 2,000 to 1,000,000.

As long as the poor solvent S can be mixed, the viscosity of the polymer solution P containing the above PC polymers is not limited. The preferred viscosity enabling efficient mixing with the inline mixer 10 is 1,000 cPs or less under room temperature. The PC polymers may be diluted by an appropriate solvent. Examples of preferred dilution solvents are lower alcohols such as methanol, ethanol, propanol, and 2-propanol. The polymer solution P may be heated when it is being fed to lower its viscosity.

The preferred poor solvent S precipitates polymers and acts to maintain impurities in a dissolved state. Examples of the preferred poor solvent S are ketons such as acetone and methyl ethyl keton, esters such as methyl acetate and ethyl acetate, a mixture of the above-mentioned poor solvents and hexane, and a mixture of the above-mentioned poor solvents and ether. If the PC polymers are insoluble in water, pure water may be used as the poor solvent S.

The polymer solution P prepared in the polymerization tank 2 is fed to the inline mixer 10. Unreacted monomers are efficiently eliminated from the polymer solution P in the inline mixer 10. This obtains PC polymers having a decreased amount of impurities such as unreacted monomers, or a high purity.

The polymer solution P and the poor solution S may be fed to the inline mixer 10 by using a pulseless pump (i.e., pumps 6*a* and 6*b*) or pressurizing the polymerization tank 2 and the solvent tank 3 with nitrogen gas as described above. The flow rate of the polymer solution P and the poor solvent S are determined so that the optimal slurry can be obtained when using the inline mixer 10 of the present invention. More specifically, the preferred flow rate of the polymer solution P is 10 m/min to 400 m/min. The preferred flow rate of the poor solvent S is 25 m/min to 1,000 m/min.

The feeding ratio of the polymer solution P and the poor solvent S is determined such that precipitations (fine grains) of PC polymers are dispersed. From the viewpoint of PC polymer precipitations having a high purity, it is preferred that the feed amount of the poor solvent S relative to the feed amount of the polymer solution P be 100% or greater. From the viewpoint of production efficiency, that is, the viewpoint of recovery rate of PC polymer precipitations and the used amount of the poor solvent, it is preferred that the feed amount of the poor solvent S relative to the feed amount of the polymer solution P be 5000% or less.

While the agitation vessel 11 is being fed with the polymer solution P and the poor solvent S, the impeller l is rotated at a rotation speed of 2,000 to 10,000 rpm. The feed pipe 15 has a multiple pipe structure. Thus, the polymer solution P and the poor solvent S are fed to the agitation vessel 11 without clogging the feed pipe 15. The rotation of the impeller 12 agitates the polymer solution P and the poor solvent S in the inline mixer 10 and sheath the polymer solution P and the poor solvent S in the shearing clearance C or at the screen 13. This produces the slurry SL that is sent to the filter 9 via the discharge port 16. The slurry SL is collected in the filter 9. Simultaneously, flesh polymer solution P and poor solvent S are fed to the agitation vessel 11 and continuously mixed.

The recovered slurry SL is filtered by the filter 9 and separated into solids and liquid. The separated wet powder is dried to obtain dry powder. Instead of filtering the slurry to recover solids and liquid, for example, while holding the slurry SL in a static state, the supernatant may be removed and the layer of precipitates may be dried. Alternately, the slurry SL may be separated into solids and liquid by using a liquid cyclone. However, the use of a filter for separating the slurry SL into solids and liquid is optimal due to the easy recovery and simple equipment.

An example of the present invention will now be discussed.

First, the feed pipe 15 having a multiple pipe structure was connected to a mixer (manufactured by Silverson Machines, Inc.) to form the inline mixer 10 of the preferred embodiment. The inline mixer 10 was used to produce polymers of synthesis examples 1 to 3.

The polymer molecular weight, unreacted monomers, and characteristic values such as the residual solvent amount and viscosity were measured.

[Measurement of Molecular Weight and Unreacted Monomers]

1. Measurement of molecular weight with gel permeation chromatography (GPC). The measurement conditions of the GPC were as follows.

GPC analyzer: SC-8020, manufactured by Tosoh Corporation,

Sample: 250 μl of a polymer solution diluted by 10 times with al elution liquid

Eluent: solution of a mixture of 4 percent by weight of methanol and 6 percent by weight of chloroform Molecular Weight: conversion value based on polyethylene glycol UV Detector: UV-8020, manufactured by Tosoh Corporation Detector Having Refractive Index: RI-8020, manufactured by Tosoh Corporation 2. Measurement of polymerization reaction rate with high performance liquid chromatography (HPLC)

Analyzer: 807-IT, manufactured by JASCO Corporation

Sample: 20 μl of a polymer solution diluted by 400 times with an elution liquid

Eluent: solution of a mixture of 90 percent by weight of ethanol and 60 percent by weight of water UV Detector: 875-UV (210 nm), manufactured by JASCO Corporation The reaction rate was obtained by performing a calculus of finite differences in which unreacted MPC and other unreacted monomers were measured with a calibration line and other parts were polymerized.

[Measurement of Viscosity]

A polymer solution was heated to 50° C., and the viscosity was measured with a rotational viscometer.

[Measurement of Residual Solvent Amount]

A test sample solution for measuring the residual solvent amount was prepared by accurately measuring 1.25 grams of the products produced in synthesis examples 1 to 3. This was dissolved in a liquid mixture of 50/50 (wt) of n-butanol (special grade reagent)/methyl isobutyl ketone (special grade reagent) with the entire weight being 25 mL.

For every 5 mL of the test sample solution, a test was conducted by performing head space gas chromatography under the conditions described below. It was determined that the residual solvent amount was small and thus approvable when the total peak area of the test sample solution was less than the total peak area of the standard solution.

The measurement conditions of the head space gas chromatography are shown below.

Measurement Device Auto System XL GC+HS40XL manufactured by PerkinElmer

Column: HP-5 30 m×0.32 mm×0.25 μm Film Thickness

Charging Inlet Condition: 250° C., 1 mL/min, detection port temperature 250° C.

Temperature Condition: 35° C. (ten minutes)→temperature rise 15° C./min→250° C. (five minutes)

Head Space Setting Condition: oven temperature 60° C., needle temperature 65° C., transfer F temperature 100° C.

Heat Sustaining Period: 15 minutes

SYNTHESIS EXAMPLE 1

Sole Polymerization of MPC

Here, 200.0 grams of MPC was dissolved in 1,050 grams of ethanol and filled into a four-neck flask, which was charged with nitrogen gas for 30 minutes. Then, 4.05 grams of azobisisobutyronitrile was added and polymerized for eight hours. The polymerization reaction rate and molecular weight were measured with the GPC. The polymerization reaction rate was 98.5%, and the weight-average molecular weight (Mw) was 121,000.

SYNTHESIS EXAMPLE 2

Polymerization of MPC 0.25-SMA0.75

Here, 67.5 grams of MPC was dissolved in 1,200 grams of 2-propanol, and 232.4 grams of n-stearyl methacrylate (SMA) was heated and dissolved at 50° C. and filled into a four-neck flask, which was charged with nitrogen gas for 30 minutes. Then, 6.50 grams of t-butyl peroxyneodecanoate was added and polymerized for six hours. The polymerization reaction rate and molecular weight were measured with the GPC. The polymerization reaction rate was 97.7%, and the weight-average molecular weight (Mw) was 43,000.

SYNTHESIS EXAMPLE 3

Polymerization of MPG 0.3-BMA0.7

Here, 211.5 grams of MPC was dissolved in 315.0 grams of pure water, and 315.0 grams of n-butyl methacrylate (BMA) was dissolved in 735.0 grams of ethanol and filled into a four-neck flask, which was charged with nitrogen gas for 30 minutes. Then, 1.76 grams of t-butyl peroxyneodecanoate was added and polymerized for eight hours. The polymerization reaction rate was 96.8%, and the weight-average molecular weight (Mw) was 522,000.

TABLE 1

| | | | Synthesis Examples | | |
|---|---|---|---|---|---|
| | | | 1 | 2 | 3 |
| Polymer | | | P-1 | P-2 | P-3 |
| Preparation | Monomer composition | PC monomer | MPC | MPC | MPC |
| | | amount | 200 g | 67.6 g | 211.5 g |
| | | Additional monomer | none | SMA | BMA |
| | | amount | — | 232.4 g | 238.5 g |
| | Molar ratio of PC monomer | | 100 mol % | 25 mol % | 30 mol % |
| | Radical initiator | name | azobisisobutyronitrile | t-butylperoxy neodecanoate | t-butylperoxy neodecanoate |
| | | amount | 4.05 g | 6.50 g | 1.76 g |
| | Solvent(s) | | ethanol 1050 g | 2-propanol 1200 g | ethanol 735 g water 315 g |
| | Monomer concentration | | 16.0 wt % | 20.0 wt % | 30.0 wt % |
| | Radical initiator concentration | | 0.32 wt % | 0.43 wt % | 0.11 wt % |
| Reaction conditions | | temperature | 60° C. | 65° C. | 60° C. |
| | | period | 8 hours | 6 hours | 8 hours |
| Result | Mw | | 120000 | 43000 | 520000 |
| | viscosity of polymer solution | | 100 cPs | 150 cPs | >5000 cPs |
| | yield (%) | | 98.5 | 97.7 | 98.8 |
| | amount of unreacted PC monomer | | 14600 ppm | 5200 ppm | 5400 ppm |
| | amount of unreacted additional monomer | | — | 18100 ppm | 6400 ppm |

EXAMPLE 1

The precipitation purification system 1 incorporating the inline mixer 10 of the preferred embodiment was used. The polymer solution P was 400 grams of the reaction liquid of polymer P-1 obtained in synthesis example 1 The poor solvent S was ether. The linear flow rate of the polymer solution P was 25 m/min. The linear flow rate of the poor solvent S was 50 m/min. The rotation speed of the impeller 12 was 3,000 rpm. The produced slurry SL was directly filtered and recovered as a cake. The wet cake was vacuum dried at 40° C. for 72 hows to recover precipitates. The impurities in the obtained precipitates were measured through the measurement methods described above. The unreacted MPC was 2,190 ppm, the residual ether was 200 ppm or less, and the residual ethanol was 200 ppm or less.

EXAMPLE 2

The precipitation purification system 1 was used. The polymer solution P was 400 grams of the reaction liquid of polymer P-2 obtained in synthesis example 2. The poor solvent S was acetone. The linear flow rate of the polymer solution P was 50 m/min. The linear flow rate of the poor solvent S was 1,000 m/min. The rotation speed of the impeller 12 was 6,000 rpm. The produced slurry SL was directly filtered and recovered as a cake. The wet cake was vacuum dried at 40° C. for 72 hours. Then, the cake was fragmented into pieces by applying a light force to recover precipitates. The impurities in the obtained precipitates were measured. The unreacted MPC was 1,300 ppm, the unreacted SMA was 960 ppm, the residual acetone was 200 ppm or less, and the residual 2-propanol was 700 ppm or less.

EXAMPLE 3

The precipitation purification system 1 was used. The polymer solution P was a solution in which 300 grams of the reaction liquid of the polymer P-3 obtained in synthesis example 3 was uniformly dissolved in 300 grams of 2-propanol (polymerization reaction dilution liquid). The poor solvent S was a liquid mixture of 98 percent by weight of acetone and 2 percent by weight of 2-propanol. The flow rate of the polymerization reaction dilution liquid was 25 m/min. The linear flow rate of the poor solvent S was 125 m/min. The rotation speed of the impeller 12 was 9,000 rpm. The produced slurry SL was directly filtered and recovered as a cake. The wet cake was vacuum dried at 40° C. for 72 hours. Then, the cake was fragmented into pieces by applying a light force to recover precipitates. The impurities in the obtained precipitates were measured. The unreacted MPC was 1,560 ppm, the unreacted BMA was 280 ppm, the residual acetone was 200 ppm or less, the residual ethanol was 800 ppm, and the residual 2-propanol was 700 ppm or less.

EXAMPLE 4

The precipitation purification system 1 was used. The polymer solution P was a solution in which 300 grams of the reaction liquid of the polymer P-3 obtained in synthesis example 3 was uniformly dissolved in 900 grams of 2-propanol (polymerization reaction dilution liquid). The viscosity of the polymerization reaction dilution liquid was 300 cPs. The poor solvent S was a liquid mixture of 98 percent by weight of acetone and 2 percent by weight of 2-propanol. The flow rate of the polymerization reaction dilution liquid was 50 m/min. The linear flow rate of the poor solvent S was 300 m/min. The rotation speed of the impeller 12 was 9,000 rpm. The produced slurry SL was directly filtered and recovered as a cake. The wet cake was vacuum dried at 40° C. for 72 hours. Then, the cake was fragmented into pieces by applying a light force to recover precipitates. The impurities in the obtained precipitates were measured. The unreacted MPC was 800 ppm, the unreacted BMA was 100 ppm or less, the residual acetone was 200 ppm or less, the residual ethanol was 850 ppm, and the residual 2-propanol was 1,100 ppm or less.

The precipitates obtained in examples 1 to 4 were powdered grains having uniform shapes and sizes, with the average grain diameter being 1.0 mm or less. Clogging did not occur in the inline mixer 10. Further, highly viscous slurry or flocculent aggregation did not adhere in the precipitation purification system 1.

COMPARATIVE EXAMPLES

Figure 7:
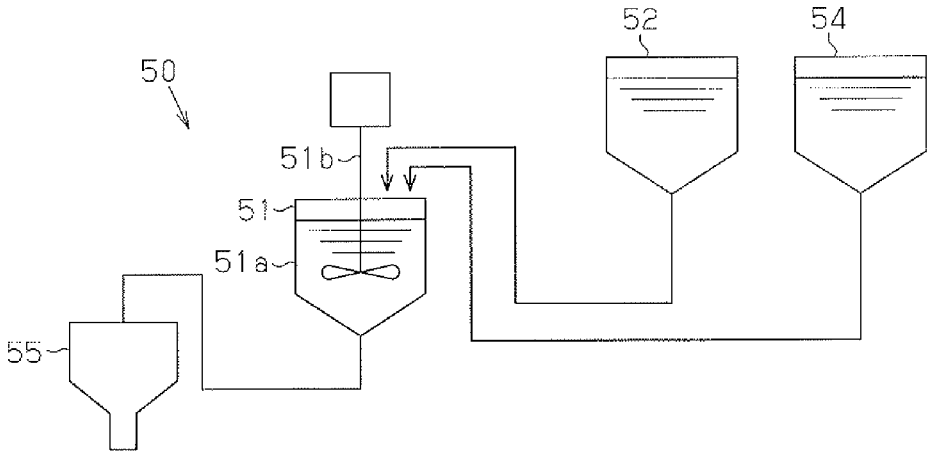
FIG. 7 is a schematic diagram showing a precipitation purification system of a comparative example.

In comparative examples 1 to 3, a precipitation purification system 50 shown in FIG. 7 was used. The precipitation differs from the precipitation purification system 1 of the present invention only in that an inline mixer 51 is used in lieu of the inline mixer 10. The purification system 50 includes a polymerization tank 52, a solvent tank 54, a filter 55, pumps (not shown), flow rate meters (not shown), and flow rate control valves (not shown) that are identical to those used in the precipitation purification system 1 of the present invention. In the inline mixer 51, an impeller agitates a polymer solution and a poor solvent while instilling the polymer solution into the poor solvent, which is fed to an agitation vessel 51*a*.

COMPARATIVE EXAMPLE 1

The precipitation purification system 50 of FIG. 7 was used. The polymer solution P was 400 grams of the reaction liquid of polymer P-1 obtained in synthesis example 1. The poor solvent S was ether. The linear flow rate of the polymer solution P was 25 m/min. The linear flow rate of the poor solvent S was 50 m/min. The rotation speed of the impeller 51*b* was 150 rpm. The produced slurry was directly filtered and recovered as a cake. The wet cake was vacuum dried at 40° C. for 72 hours to recover precipitates. The impurities in the obtained precipitates were measured. The unreacted MPC was 8,470 ppm, the residual ether was 4,800 ppm or less, and the residual ethanol was 4,700 ppm or less.

COMPARATIVE EXAMPLE 2

The precipitation purification system 50 of FIG. 7 was used. The polymer solution P was 400 grams of the reaction liquid of polymer P-2 obtained in synthesis example 2. The poor solvent S was acetone. The linear flow rate of the polymer solution P was 50 m/min. The linear flow rate of the poor solvent S was 1,000 m/min. The rotation speed of the impeller 51*b* was 150 rpm. The produced slurry was directly filtered and recovered as a cake. The wet cake was vacuum dried at 40° C. for 72 hours. Then, the cake was fragmented into pieces by applying a light force to recover precipitates. The impurities in the obtained precipitates were measured. The unreacted MPC was 3,340 ppm, the unreacted SMA was 4,530 ppm, the residual acetone was 2,800 ppm, and the residual 2-propanol was 7,000 ppm.

COMPARATIVE EXAMPLE 3

The precipitation purification system 50 of FIG. 7 was used. The polymer solution P was a solution in which 300 grams of the reaction liquid of the polymer P-3 obtained in synthesis example 3 was uniformly dissolved in 900 grams of 2-propanol polymerization reaction dilution liquid). The viscosity of the polymerization reaction dilution liquid was 300 cPs. The poor solvent S was a liquid mixture of 98 percent by weight of acetone and 2 percent by weight of 2-propanol. The flow rate of the polymerization reaction dilution liquid was 50 m/min. The linear flow rate of the poor solvent S was 300 m/min. The rotation speed of the impeller 51*b* was 150 rpm. The produced slurry was directly filtered and recovered as a cake. The wet cake was vacuum dried at 40° C. for 72 hours.

Then, the cake was fragmented into pieces by applying a light force to recover precipitates. The impurities in the obtained precipitates were measured. The unreacted MPC was 3,200 ppm, the unreacted BMA was 570 ppm, the residual acetone was 8,100 ppm or less, the residual ethanol was 7,000 ppm, and the residual 2-propanol was 8,600 ppm.

The precipitates obtained in comparative examples 1 to 3 were masses of different shapes and sizes, with the masses having dimensions of 1.0 to 20 mm. The masses were larger than the powdered grains of examples 1 to 4 and had different sizes.

TABLE 2

| | | | Example 1 | Comparative Example 1 |
|---|---|---|---|---|
| Polymer viscosity before precipitation treatment | | | P-1<br>100 cPs | P-1<br>100 cPs |
| Poor solvent | | | ether | ether |
| Result | precipitation appearance | | white powder | white aggregation |
| | amounts of impurities | PC monomer | 2190 ppm | 8470 ppm |
| | | ether | <200 ppm | 4800 ppm |
| | | ethanol | <200 ppm | 4700 ppm |
| | | total | 2590 ppm | 17970 ppm |

TABLE 3

| | | | Example 2 | Comparative Example 2 |
|---|---|---|---|---|
| Polymer viscosity before precipitation treatment | | | P-2<br>150 cPs | P-2<br>150 cPs |
| Poor solvent | | | acetone | acetone |
| Result | precipitation appearance | | white powder | white aggregation |
| | amounts of impurities | PC monomer | 1300 ppm | 3340 ppm |
| | | additional monomer | 960 ppm | 4530 ppm |
| | | acetone | <200 ppm | 2800 ppm |
| | | 2-propanol | 700 ppm | 7000 ppm |
| | | total | 3160 ppm | 17670 ppm |

TABLE 4

| | | | Example 3 | Example 4 | Comparative Example 3 |
|---|---|---|---|---|---|
| Polymer viscosity before precipitation treatment | | | P-3<br>1200 cPs | P-3<br>180 cPs | P-3<br>180 cPs |
| Poor solvent | | | acetone | acetone | acetone |
| Result | precipitation appearance | | white powder | white powder | white aggregation |
| | amounts of impurities | PC monomer | 1560 ppm | 800 ppm | 3200 ppm |
| | | additional monomer | 280 ppm | <100 ppm | 570 ppm |

TABLE 4-continued

| | Example 3 | Example 4 | Comparative Example 3 |
|---|---|---|---|
| acetone | <200 ppm | <200 ppm | 8100 ppm |
| ethanol | 800 ppm | 850 ppm | 7000 ppm |
| 2-propanol | 1000 ppm | 1100 ppm | 8600 ppm |
| total | 3840 ppm | 2780 ppm | 27470 ppm |

The examples 1 to 4 using the inline mixer 10 obtain PC polymers having less residual solvent and a higher purity compared to comparative examples 1 to 3.

The preferred embodiment has the advantages described below.

(1) The feed pipe 15 for feeding the inline mixer 10 with the polymer solution P and the poor solvent S has a multiple pipe structure including the outer pipe 20 and the inner pipe 21. Thus, the polymer solution P and the poor solvent S are separately fed to the agitation vessel 11 of the inline mixer 10. This prevents the solution P and the solvent S from being mixed in the feed pipe 15 in which the shearing force of the impeller 12 is not applied. As a result, the production of a slurry SL containing impurities is prevented, and clogging caused by flocculent aggregation is prevented beforehand. Further, the poor solvent S enters the agitation vessel 11 in a state encompassing the polymer solution P. Thus, the polymer solution P effectively contacts the poor solvent S. Further, the polymer solution P and the poor solvent S are simultaneously fed to the shearing clearance C between the impeller 12 and the agitation vessel 11. Thus, the polymer solution P and the poor solvent S are sheared by the impeller 12 as soon as they reach the shearing clearance. This produces fine grains with the slurry SL before the polymer solution P flocculates. Further, polymer grains containing impurities are not produced, and polymer grains having a controlled (small and uniform) grain diameter are produced.

(2) The outlet 20*a* of the outer pipe 20 and the outlet 21*a* of the inner pipe 21 are arranged in the vicinity of the distal end of the rotary shaft 17. Further, the outlets 20*a* and 21*a* are coaxial with the rotary shaft 17 of the impeller 12. Thus, the polymer solution P and poor solvent S drawn through the outlets 20*a* and 21*a* are dispersed toward the distal ends 18*b* of the rotor blades 18 from the rotary shaft 17 by the rotation of the impeller 12. This agitates the polymer solution P and the poor solvent S without any delays and produces polymer grains having a controlled (uniform) size and shape.

(3) The feed pipe 15 is generally parallel to the rotary shaft 17 of the impeller 12, and the polymer solution P and poor solvent S are drawn into the agitation vessel 11 along the rotary shaft 17. The rotation direction of the rotor blades 18 is generally perpendicular to the direction in which the polymer solution P and the poor solvent S are drawn into the agitation vessel 11. Thus, a strong shearing force can be applied to the polymer solution P and the poor solvent S.

(4) The shearing clearance C, which is formed between the rotor blades 18 of the impeller 12 and the lid 11*b* of the agitation vessel 11 is 0.5 to 30.0 mm. Thus, a large shearing force can be applied to the polymer solution P and the poor solvent S that enters the shearing clearance C.

The preferred and illustrated embodiment may be modified as described below.

The main body 11*a* and lid 11*b* of the agitation vessel 11 are separate components. However, the main body 11*a* and the lid 11*b* may be formed integrally with each other. Further, the agitation vessel 11 and the discharge pipe 19 may be directly connected to each other. The shape of the agitation vessel 11 is not particularly limited.

At least one of the outer pipe 20 and the inner pipe 21 may be formed integrally with the lid 11*b* of the agitation vessel 11.

The inline mixer 10 is used to form PC polymer grains. However, the inline mixer 10 may be used to perform agitation required for crystallization or polymerization.

Figure 8A:
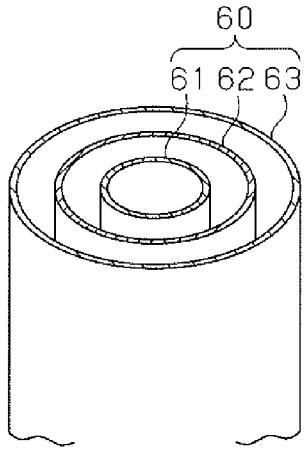
FIG. 8A is a cross-sectional view showing a feed pipe according to a further embodiment of the present invention.
Figure 8B:
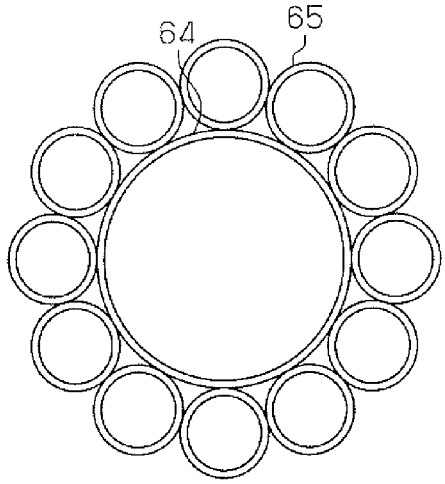
FIG. 8B is a schematic view showing a feed pipe according to another embodiment of the present invention.
Figure 9:
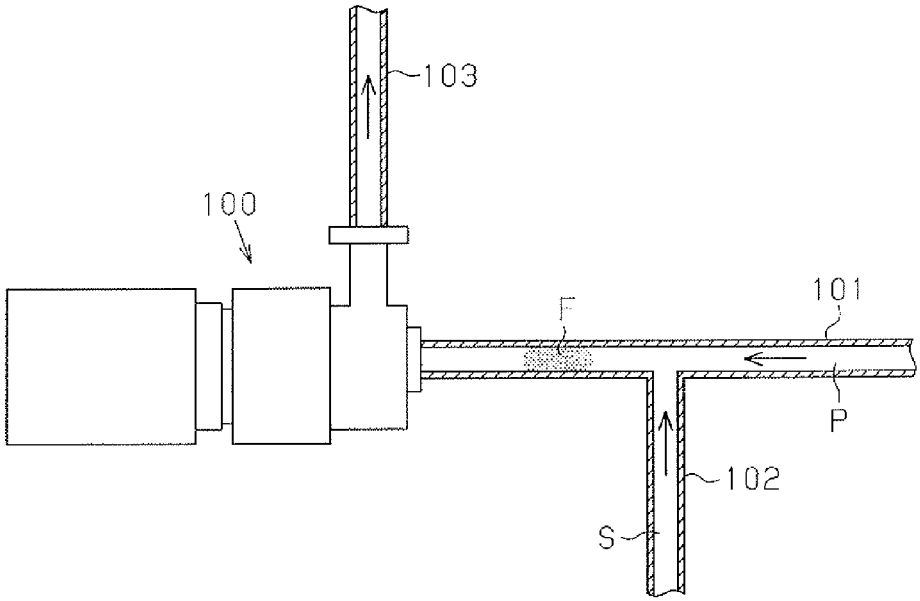
Fig.9(Prior Art)
FIG. 9 is a schematic diagram showing an inline mixer of the prior art.

The feed pipe 15 is not limited to the coaxial pipe structure and may have any multiple pipe structure. For example, the outer pipe 20 and the inner pipe 21 do not have to be coaxial. Further, the feed pipe 15 may have a structure formed by three or more structures. For example, FIG. 8A shows a feed pipe 60 including a first pipe 61, a second pipe 62 having a larger diameter than the first pipe 61, and a third pipe 63 having a larger diameter than the second pipe 62. The first and second pipes 61 and 62 function as an inner pipe, and the third pipe 63 functions as an outer pipe. In this case, three or more types of liquids (fluids including a solid, liquid, or gas) may be fed, mixed, and agitated in the agitation vessel 11. FIG. 8B shows a feed pipe having a multiple pipe structure. In FIG. 8B, an inner pipe 64 is surrounded by a plurality of outer pipes 65 having a diameter that is small than that of 10 the inner pipe 65. In this case, the liquid (fluid) flowing through the outer pipes 65 does not have to be supplied from the same source. This is effective when feeding liquids from a plurality of sources.

It should be apparent to those skilled in the art that the present invention may be embodied in many other specific forms without departing from the spirit or scope of the invention. Therefore, the present examples and embodiments are to be considered as illustrative and not restrictive, and the invention is not to be limited to the details given herein, but may be modified within the scope and equivalence of the appended claims.

What is claimed is:

1. An agitation mixer for agitating a solution and a solvent that precipitates a solid substance dissolved in the solution, the agitation mixer comprising:

an agitation vessel;

an impeller including radially extending rotor blades rotatably arranged in the agitation vessel for shearing the solution and the solvent when rotated;

a feed unit having a feed pipe structure formed of a plurality of feed pipes including an inner pipe and an outer pipe arranged outside the inner pipe;

a discharge port for discharging agitated fluid from the agitation vessel; and a screen having through holes and arranged around the impeller so as to form a clearance between distal ends of the rotor blades and an inner surface of the screen in the agitation vessel;

wherein a shearing clearance is formed between the feed unit and the radially extending rotor blades of the impeller, the outer pipe feeds one of the solution and the solvent to the shearing clearance, the inner pipe feeds the other one of the solution and the solvent to the shearing clearance, and the solution and the solvent initially come in contact with each other in the shearing clearance.

2. The agitation mixer according to claim 1, wherein the feed unit includes dual pipes.

3. The agitation mixer according to claim 1, wherein:

the inner pipe is coaxially arranged in the outer pipe, and the outer pipe and the inner pipe are coaxial with a rotary shaft of the impeller at a location at which the feed unit and agitation vessel are connected to each other.

4. The agitation mixer according to claim 1, wherein the shearing clearance is 0.5 mm to 30 mm.

5. An agitation mixer for agitating a solution and a poor solvent that precipitates a polymer composition dissolved in the solution and obtained by polymerizing a monomer composition and a poor solvent, the agitation mixer comprising:

an agitation vessel;

an impeller including radially extending rotor blades rotatably arranged in the agitation vessel for shearing the solution and the poor solvent when rotated;

a feed unit having a feed pipe structure formed of a plurality of feed pipes including an inner pipe and an outer pipe arranged outside the inner pipe;

a discharge port for discharging agitated fluid from the agitation vessel; and a screen having through holes and arranged around the impeller so as to form a clearance between distal ends of the rotor blades and an inner surface of the screen in the agitation vessel;

wherein a shearing clearance is formed between the feed unit and the radially extending rotor blades of the impeller, the outer pipe feeds one of the solution and the poor solvent to the shearing clearance, the inner pipe feeds the other one of the solution and the poor solvent to the shearing clearance, and the solution and the poor solvent initially come in contact with each other in the shearing clearance.

6. The agitation mixer according to claim 5, wherein:

the feed pipe structure is a dual pipe structure formed by the outer pipe and the inner pipe;

the outer pipe feeds the poor solvent; and the inner pipe feeds the polymer composition.

7. The agitation mixer according to claim 5, wherein:

the inner pipe is coaxially arranged in the outer pipe, and the outer pipe and the inner pipe are coaxial with a rotary shaft of the impeller at a location at which the feed unit and agitation vessel are connected to each other.

8. The agitation mixer according to claim 5, wherein the shearing clearance is 0.5 mm to 30 mm.

9. An agitation mixer for agitating a liquid composition and a poor solvent that precipitates a phosphorylcholine base polymer dissolved in the liquid composition, the agitation mixer comprising:

an agitation vessel;

an impeller including radially extending rotor blades rotatably arranged in the agitation vessel for shearing the liquid composition and the poor solvent when rotated;

a feed unit having a feed pipe structure formed of a plurality of feed pipes including an inner pipe and an outer pipe arranged outside the inner pipe;

a discharge port for discharging agitated fluid from the agitation vessel; and a screen having through holes and arranged around the impeller so as to form a clearance between distal ends of the rotor blades and an inner surface of the screen in the agitation vessel;

wherein a shearing clearance is formed between the feed unit and the radially extending rotor blades of the impeller, the outer pipe feeds one of the liquid composition and the poor solvent to the shearing clearance, the inner pipe feeds the other one of the liquid composition and the poor solvent to the shearing clearance, and the liquid composition and the poor solvent initially come in contact with each other in the shearing clearance.

10. The agitation mixer according to claim 9, wherein:

the feed pipe structure is a dual pipe structure formed by the outer pipe and the inner pipe;

the outer pipe feeds the poor solvent; and the inner pipe feeds the polymer composition.

11. The agitation mixer according to claim 9, wherein:

the inner pipe is coaxially arranged in the outer pipe, and the outer pipe and the inner pipe are coaxial with a rotary shaft of the impeller at a location at which the feed unit and agitation vessel are connected to each other.

12. The agitation mixer according to claim 9, wherein the shearing clearance is 0.5 mm to 30 mm.

* * * * *